United States Patent [19]

Lazar et al.

[11] Patent Number: 4,625,189

[45] Date of Patent: Nov. 25, 1986

[54] CIRCUIT RECLOSER WITH ACTUATOR FOR TRIP, CLOSE AND LOCK OUT OPERATION

[75] Inventors: Lawrence W. Lazar, Elm Grove; Ronald A. Wainio, South Milwaukee, both of Wis.

[73] Assignee: Cooper Industries, Inc., Houston, Tex.

[21] Appl. No.: 778,358

[22] Filed: Sep. 20, 1985

[51] Int. Cl.[4] ..... H01H 75/00; H01H 77/00; H01H 83/00

[52] U.S. Cl. ..... 335/10; 335/26; 335/27; 335/170; 335/189; 200/153 J; 200/153 SC

[58] Field of Search ..... 335/10, 26, 27, 170, 335/189, 190, 191; 200/153 J, 153 SC

[56] References Cited

U.S. PATENT DOCUMENTS

| | | | |
|---|---|---|---|
| 2,804,521 | 8/1957 | Ryan et al. | 335/9 |
| 2,810,038 | 9/1957 | Ryan et al. | 335/10 |
| 2,994,805 | 8/1961 | Nash | 335/10 |

*Primary Examiner*—E. A. Goldberg

*Assistant Examiner*—Lincoln D. Donovan

*Attorney, Agent, or Firm*—Nelson A. Blish; Eddie E. Scott; Alan R. Thiele

[57] ABSTRACT

In a high voltage circuit interrupter switch or recloser a single multi-function control actuator is connected to a trip bar for tripping contact operating linkage to effect opening of one or more movable contacts. The control actuator includes a spring biased crank member and a toggle linkage operably associated to permit resetting of the control actuator to its initial position upon effecting movement of the contact operating linkage. The recloser has a switch for energizing a closing solenoid to reclose the interrupter contact. A movable catch is associated with switch operating linkage and is operably connected to the control actuator whereby the control actuator may effect energization of the solenoid to close the interrupter contacts. The control actuator is also connected to a lockout linkage for effecting lockout of the contact operating linkage upon receipt of a control signal when a predetermined number of circuit interruptions have been performed in a predetermined time period.

26 Claims, 22 Drawing Figures

CIRCUIT RECLOSER WITH ACTUATOR FOR TRIP, CLOSE AND LOCK OUT OPERATION

BACKGROUND OF THE INVENTION

1. Field of the Invention

The present invention pertains to a high voltage circuit interrupter or recloser having an actuator for tripping the recloser contacts, effecting closure of the recloser contacts and for locking out the contacts in response to a control signal.

2. Background

In the art of high voltage circuit interrupter switches, and specifically the type of switch known as a recloser, it has been conventional to provide separate solenoid or similar power operated actuators for effecting tripping or opening of the interrupter contacts and operation to reclose the contacts. In applications where a lockout of the contact actuating mechanism is desirable after a repeated number of tripping and reclosing cycles there have been efforts to develop lockout mechanisms and actuators which receive a separate control signal or effect lockout after a predetermined number of trip actuator operating cycles.

The reliability requirements for high voltage circuit interrupter switches and reclosers is particularly great. These devices are used in electrical distribution systems and malfunction of the devices is often intolerable. Accordingly, there has been an ever present need and desire to improve such devices and to reduce the cost of manufacture while maintaining the quality and reliable operation demanded. In this regard, it is important to consider eliminating as much as possible the number of separate actuators required to perform the contact tripping, reclosing and lockout functions. The present invention provides an improved circuit interrupter or recloser device having actuator means for effecting the operation of the switch mechanism to trip or open the interrupter contacts, reclose the interrupter contacts and lock the contact actuating mechanism in a contact open position upon receipt of a suitable signal from a control circuit.

SUMMARY OF THE INVENTION

The present invention provides an improved circuit interrupter switch, in particular, a multiphase circuit interrupter or recloser of the type used in connection with high voltage electrical power distribution systems.

In accordance with one aspect of the present invention, there is provided a circuit interrupter switch having a mechanism for tripping or opening a plurality of switch contacts simultaneously, reclosing the switch contacts after a predetermined time interval and locking out of the contacts in the open position in the event of failure to clear the fault condition which initiated opening of the contacts.

The improved mechanism of the present invention includes a single multi-purpose actuator adapted to receive a control signal for effecting movement of the contact operating mechanism to cause simultaneous opening movement of one or more contact actuating members to interrupt the main electrical circuit. The single actuator is also adapted to initiate operation of the contact operating mechanism to reclose the interrupter contacts upon receipt of a suitable control signal.

In accordance with still another aspect of the present invention, the actuator for initiating tripping and reclosing of the main interrupter contacts is also adapted to effect operation of a lockout mechanism to prevent reclosure of the contacts.

In a preferred embodiment of the invention, the multipurpose actuator comprises a bi-stable type electrically energized actuator which is operable to receive an electrical signal from a suitable control circuit to move from one stable position to another stable position. The actuator is preferably reset to the first stable position in preparation for another actuating cycle by a unique resetting mechanism.

In accordance with yet a further aspect of the present invention a circuit interrupter or recloser is provided which has improved linkage which locks the main interrupter contact operating mechaism in a position to prevent reclosure of the interrupter contacts.

The abovenoted features and superior aspects of the present invention as well as additional advantages thereof will be further appreciated by those skilled in the art upon reading the detailed description which follows in conjunction with the drawing.

DESCRIPTION OF THE PREFERRED EMBODIMENT

Figure 1:
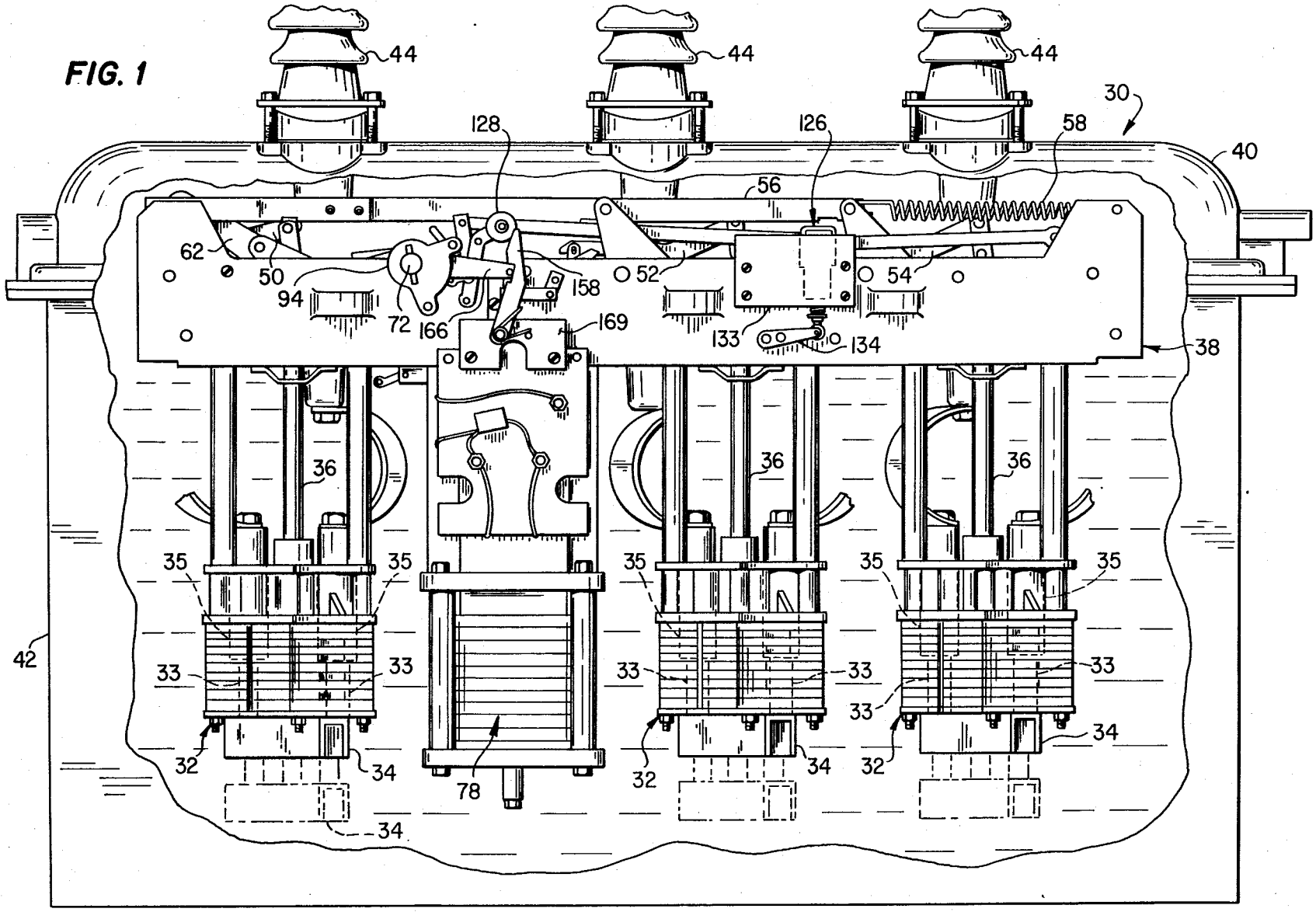
FIG. 1 is a front elevation, partially broken away, of a multiphase circuit interrupter switch including the improved control and actuating mechanism of the presnt invention.

In the description which follows like parts are marked throughout the specification and drawing with the same reference numerals, respectively. The drawing figures are not necessarily to scale and certain features of the invention may be shown exaggerated in scale or in somewhat schematic form in the interest of clarity.

Referring to FIG. 1, there is illustrated a circuit interrupter device, generally designated by the numeral 30, of a type typically used on three phase relatively high voltage electrical power distribution systems. The circuit interrupter device 30 is configured in the form of a recloser device, that is, the device is adapted to simultaneously open three contact assemblies 32 to interrupt the flow of current through a distribution network in the event of an overload or fault condition. The device 30 is also adapted to immediately reclose the interrupted circuit and, if the fault condition persists after a specified number of opening and reclosing operations, to effect a lockout condition to prevent further transmission of electrical power through the device.

The contact assemblies 32 are exemplary and are each of a type comprising movable contacts 33 connected to a crosshead member 34 which is, in turn, connected to an operating rod 36. Stationary contacts 35 are engageable with the contacts 33, as shown in FIG. 1. A detailed description of the interrupter contact assemblies 32 is not believed to be necessary to an understanding of the present invention. U.S. Pat. Nos. 2,804,521 and 2,810,038 to Anthony Van Ryan, et al, describe circuit interrupters having interrupter contact assemblies similar to the contact assemblies 32 and reference to these patents may be had for a further detailed description of devices similar in some respects to parts of the circuit interrupter device 30. Those skilled in the art will recognize that other types of circuit interrupting contacts may be used in conjunction with the present invention.

The interrupter contact assemblies 32 are supported on a frame 38 which, in turn, is mounted on a head 40. The head 40 is secured to a tank 42 which may be filled with an insulating and arc interrupting fluid in a conventional manner. The head 40 supports a plurality of insulator bushings 44 which are disposed around and in supportive relationship to suitable conductor members, not shown, leading to the interrupter contact of the circuit interrupter device 30 may be obtained by referring to the aforementioned patents.

Figure 2:
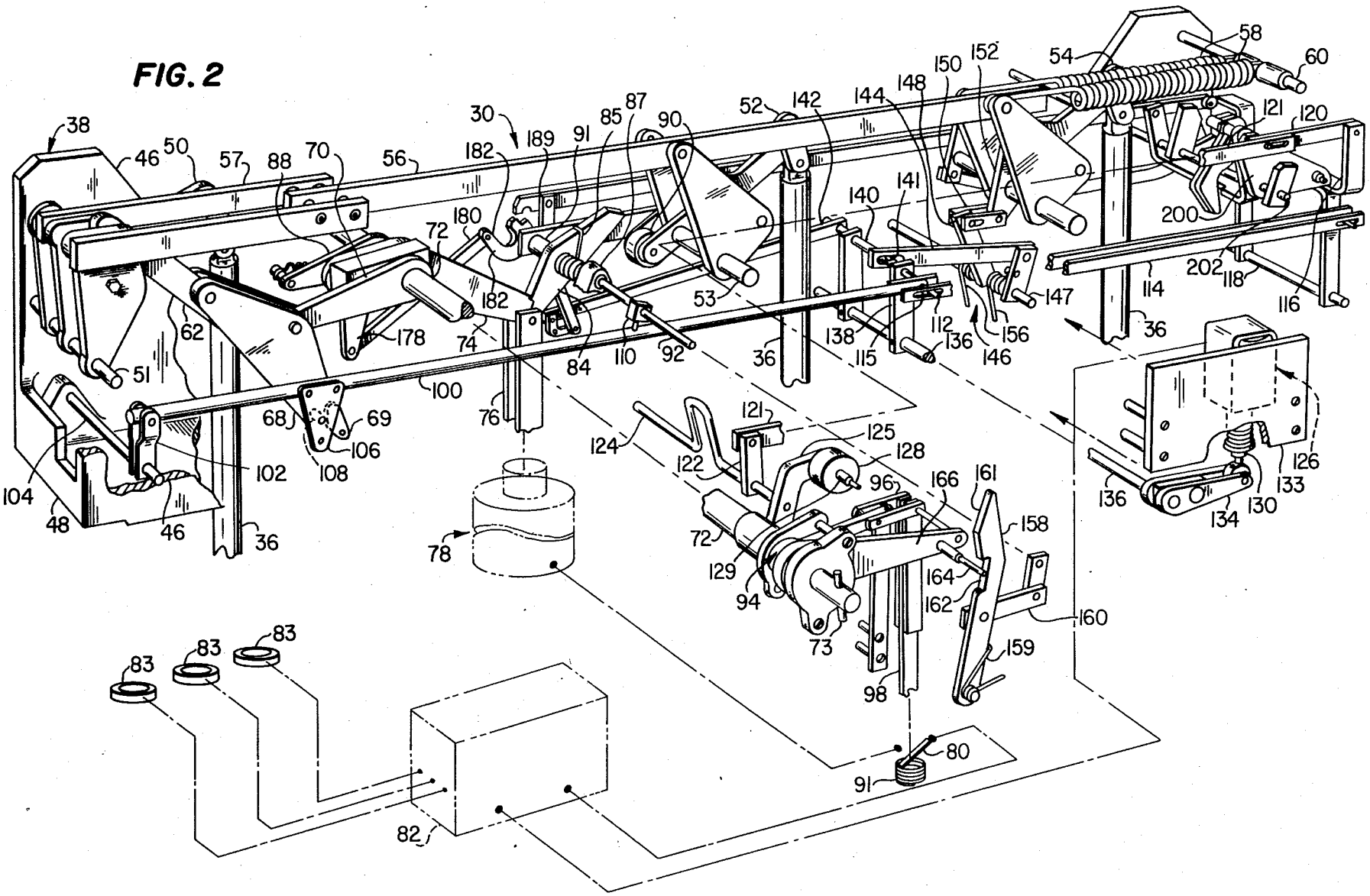
FIG. 2 is a perspective view of the interrupter contact operating mechanism and the control actuating mechanism, portions of which are separated for clarity.
Figure 3:
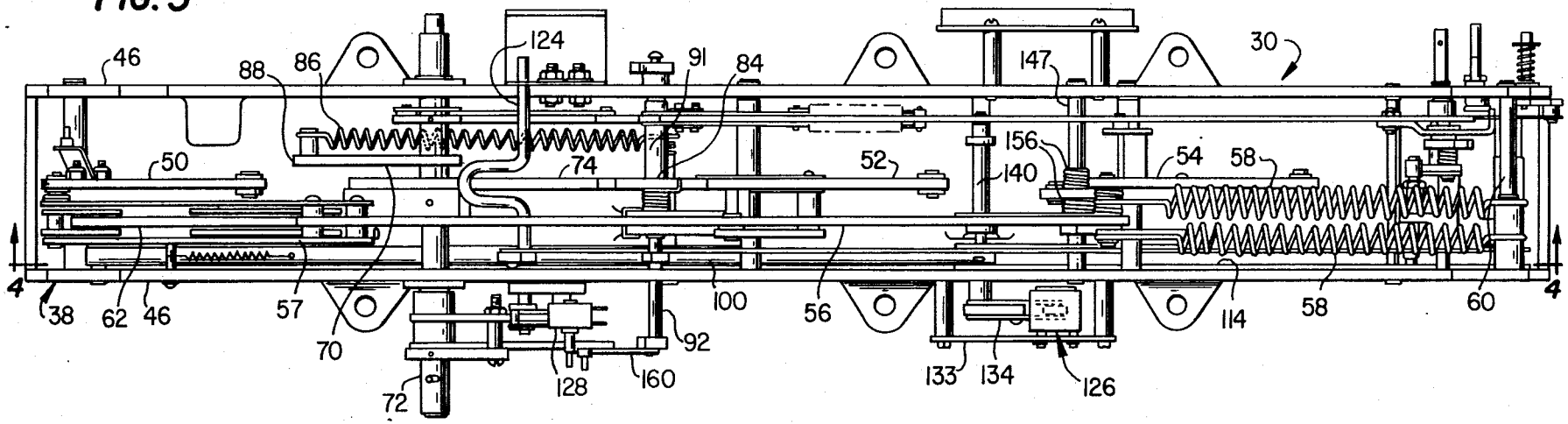
FIG. 3 is a plan view of the interrupter contact operating mechanism and the control actuating mechanism.
Figure 4:
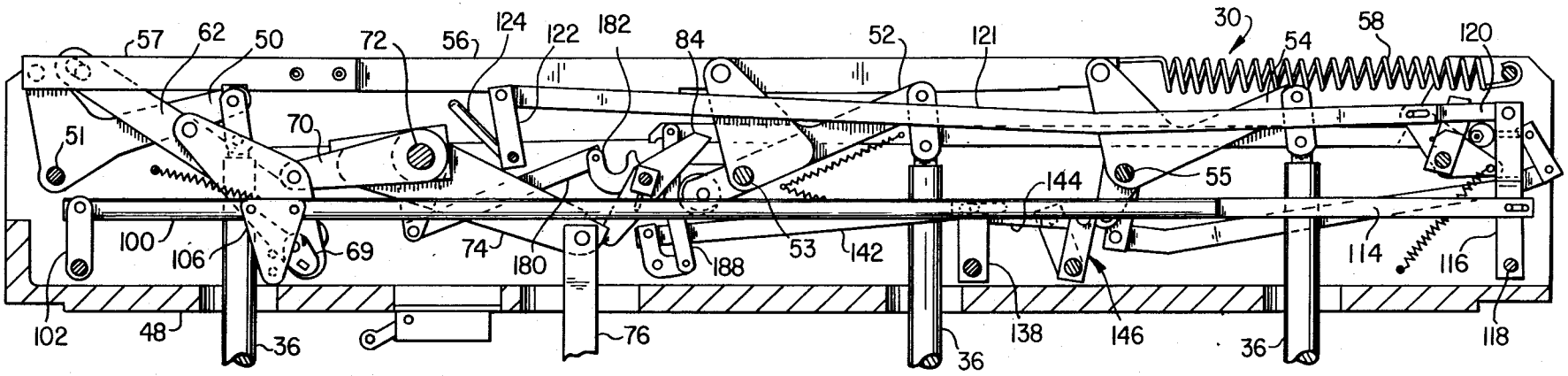
FIG. 4 is a section view taken along the line 4—4 of FIG. 3.

Referring now to FIGS. 2, 3 and 4, in particular, there is illustrated an arrangement of mechanism for simultaneously actuating the interrupter contact operating rods 36 to simultaneously interrupt the flow of current in all three conductors connected to the interrupter device 30. The frame 38 is characterized by a somewhat channel shaped member having opposed flanges 46 interconnected by a base or web portion 48. Only a portion of the frame 38 is illustrated in FIG. 2 in the interest of clarity. The operating rods 36 are each connected to respective crank members 50, 52 and 54 which are mounted between the flanges 46 on respective pivot shafts 51, 53 and 55. The crank members 50, 52 and 54 each include portions which are pivotally connected to an elongated transfer bar 56 which includes a yoke 57 at one end and is connected at the other end to a pair of biasing springs 58. The springs 58 are secured at one end to the transfer bar 56 and at their opposite ends to a rod member 60 extending between the flanges 46. The transfer bar 56 is biased to move to the right, viewing FIG. 4 to move the crank members 50, 52 and 54 in a clockwise direction to extend the interrupter contact operating rods 36 downwardly. The transfer bar yoke 57 is also connected to a toggle latch member 62 at one end of the latch member.

Figure 5:
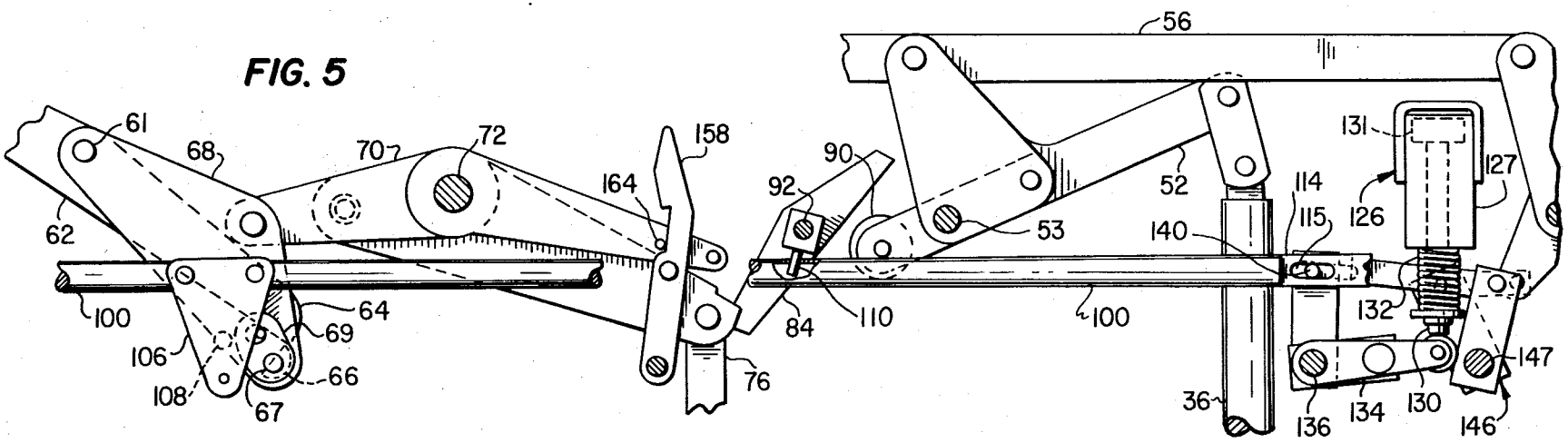
FIG. 5 is a detail view of the contact operating linkage and latching mechanism and portions of the control actuating mechanism in the closed condition of the interrupter contacts.
Figure 6:
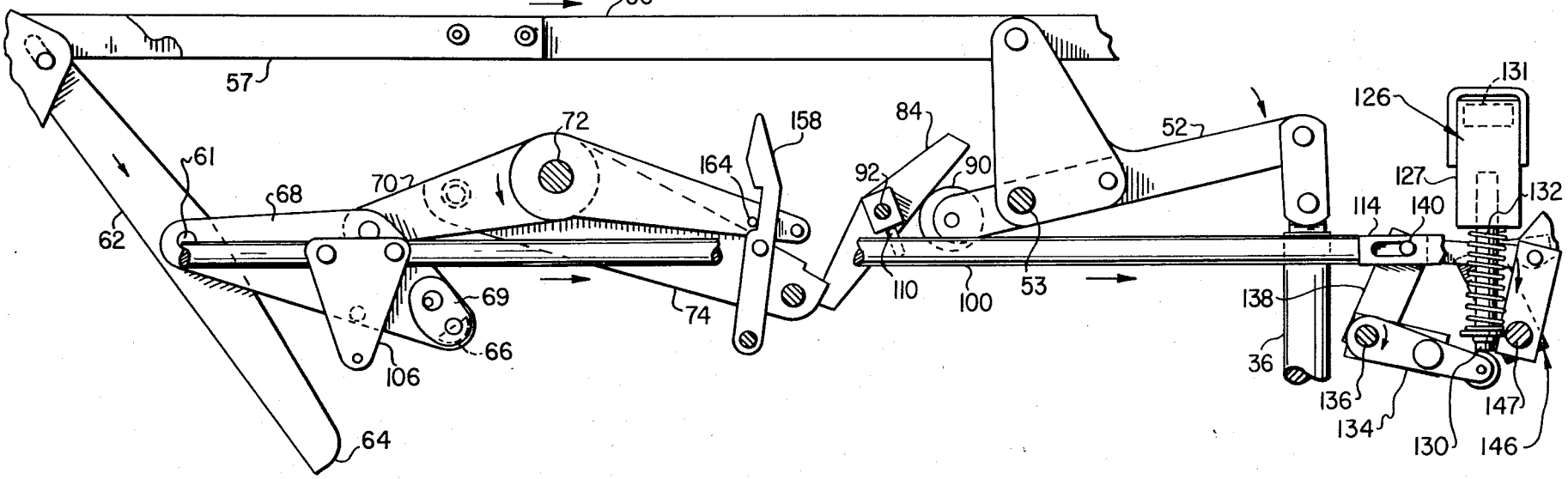
FIG. 6 is detail view similar to FIG. 5 illustrating the contact operating mechanism moving toward the contact open position.

Referring briefly to FIG. 5 also, the opposite end of the latch member 62 includes a latch edge 64 engageable with a rotatable cam 66 which is mounted on a member 68 pivotally connected to the latch member 62. The cam 66 has a control edge 67 and a pivot link portion 69 for rotating the cam to allow the latch edge 64 to disengage from the cam 66. Figure 6 illustrates a condition wherein the latch 62 has disengaged from the latch cam 66.

The member 68 is connected to a link 70 which is keyed for rotation with a transverse control shaft 72. As illustrated in FIG. 3, the control shaft 72 extends between and on either side of the frame flanges 46. As illustrated in FIGS. 2 and 4, a crank arm 74 is also keyed for rotation with the shaft 72 and is connected at its distal end with the upper end of a solenoid plunger 76. The plunger 76 is part of motor means compirsing a solenoid actuator 78, FIG. 2, which is operable to be energized by closure of a switch 80 which may receive a suitable electrical signal from a control unit 82 or directly from the main electrical conductors connected to the device 30. In either case the solenoid 78 is operable to be energized or deenergized by actuation of the switch 80.

In response to energization of the solenoid actuator 78, the plunger 76 is moved downwardly, viewing FIGS. 4 and 5, to rotate the crank arm 74 and the shaft 72 to a position to lock the latch 62, in engagement with the cam 66, in the position illustrated. In this position of the crank arm 74 a solenoid latch 84 engages the crank arm 74 to hold the plunger 76 in the position illustrated in FIG. 5 against the bias of a spring 86, FIG. 3, connected to a link 88 and which urges the solenoid plunger 76 to move upwardly. The latch 84 is engageable by a roller cam 90 secured to the crank member 52. Accordingly, during movement of the transfer bar 56 from the FIG. 5 position to the FIG. 6 position, the cam 90 engages the latch 84 to pivot the latch to disengage from the crank arm 74. The latch 84 is supported on a tubular shaft 91 which is supported between a boss 87 and a frame flange 46, FIG. 3. A shaft 92 is coaxial with and supported partially by shaft 91 and extends in the opposite direction from boss 87 as illustrated.

Figure 7:
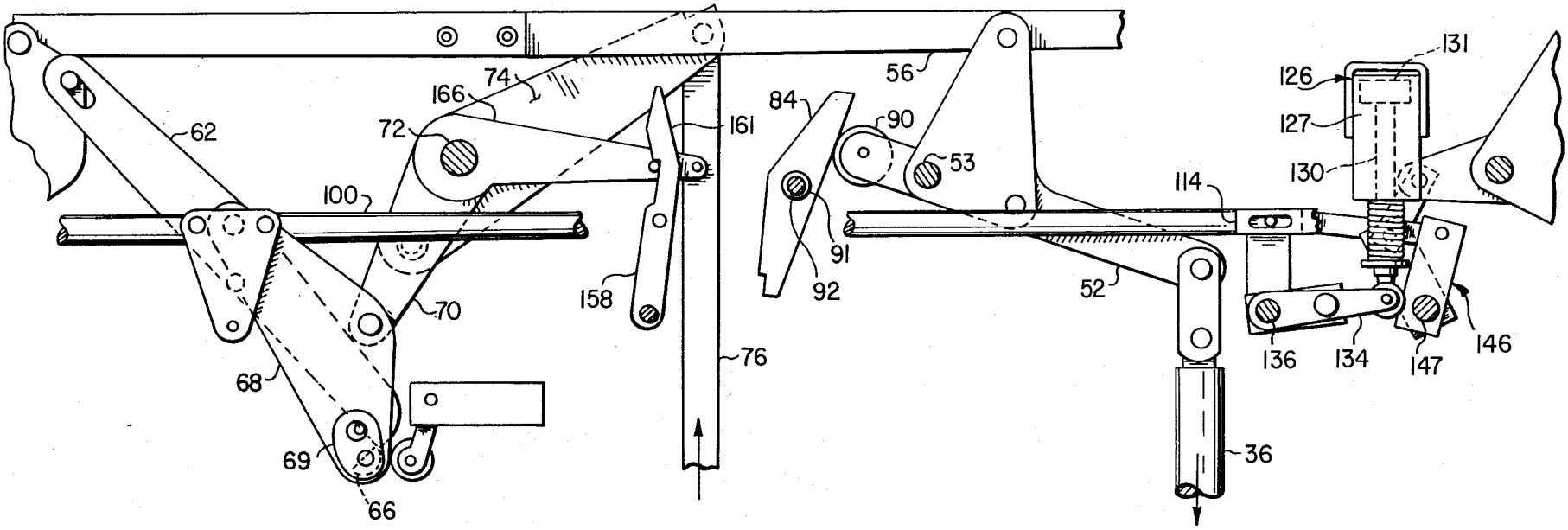
FIG. 7 is a detail view showing the operating mechanism latch reset and the control actuator reset in the position wherein the interrupter contacts are fully opened.

Referring to FIG. 7, as the transfer bar 56 translates the cranks 50, 52 and 54 to the fully open position of the interrupter contacts, the link 70 and the member 68 will reset the contact tripping latch formed by the latch member 62 and the cam 66. As the shaft 72 is rotated clockwise, viewing FIG. 7, in response to downward movement of the plunger 76 to move the linkage illustrated in FIGS. 5 through 7 back to the FIG. 5 position, the contact tripping latch is reset, as shown in FIG. 5, and the solenoid latch 84 becomes engaged with the crank arm 74.

Referring again primarily to FIG. 2, the shaft 72 is connected to linkage 94 which is operable to engage an arm assembly 96 connected to a solenoid switch actuating member 98. In response to rotation of the shaft 72 in a clockwise direction, in response to downward retraction of the plunger 76 at the fully rotated and closed condition of the contactor actuating rods 36, the linkage 94, arm assembly 96 and actuating member 98 will operate to open the solenoid switch 80 to deenergize the solenoid 78 at a condition wherein the crank arm 74 is latched by the latch member 84 and the latch 62 is cocked in the FIG. 5 position. The linkage 94 is preferably of a type used on model RVE and WVE three phase reclosers manufactured by McGraw-Edison Power Systems Div., Milwaukee, Wis.

Referring further to FIG. 2, the interrupter device 30 includes an improved mechanism for tripping the mechanism connected to the interrupter contact actuating rods 36 to move the interrupter contacts to an open position through the linkage described above. As illustrated in FIG. 2, an elongated trip bar 100 is connected at one end to a clevis 102 mounted for pivotal movement on a shaft 104 on the frame 38. The trip bar 100 supports a depending part 106 which includes a latch trip pin 108. Movement of the trip bar 100 to the right, viewing FIGS. 2, 5 and 6, will cause the trip pin 108 to engage the link 69 to rotate the cam 66 out of its latching position and thereby allowing the latch 62 to pivot about a pivot point 61, FIG. 6, to commence movement under the urging of springs 58 to force the transfer bar 56 and the crank members 50, 52 and 54 in a direction to effect simultaneous opening of all three of the interrupter contact assemblies 32. The cam 66 is preferably provided with a biasing spring, not shown, for resetting the position of the cam 66 after tripping by the trip pin 108.

As shown in FIG. 2, the trip bar 100 is also connected to a pin member 100 which is keyed to the shaft 92 for rotation therewith. The trip bar 100 is connected by a lost motion coupling 112 to a lockout link 114 which in turn is connected to a lockout bail 116. The bail 116 is pivotally supported on the frame 38 by a pivot shaft 118. The bail 116 is also connected through an actuator rod assembly 120, 121 to an arm 122 which is keyed to a shaft 124 supported between the frame flanges 46 for rotation thereon. The shaft 124 is operable to rotate a lockout roller support arm 125 having a lockout roller 128 disposed thereon. The lockout roller 128 is pivotable into a position to be described in further detail herein for holding the switch actuator member 98 in a position to prevent closure of the switch 80 and energization of the solenoid actuator 78.

Referring still further to FIG. 2, the trip bar 100 is adapted to be actuated to effect tripping of the latch 62 by a bi-stable control actuator generally designated by the numeral 126. The actuator 126 is characterized as a solenoid type actuator, of a type which is commercially available, which is adapted to be biased in a stable first position and in response to receiving an electrical signal move to a stable and biased second position. The actuator 126 may also be characterized as a pneumatic or hydraulic cylinder type actuator or a conventional solenoid type actuator. The actuator 126 is adapted to receive a control signal from the control unit 82. The control unit 82 may, for example, sense an overload current in the conductors to be interrupted by the device 30 from respective current transformers 83. At a predetermined current level through any of the three conductors being controlled by the device 30, the control unit 82 is operable to send an actuating signal to the control actuator 126 to effect operation of same to move the trip bar 100 to the right viewing FIGS. 2, 5 and 6.

As illustrated in FIGS. 5 and 6, the actuator 126 includes an actuator member comprising a plunger 130 which is biased in the position shown in FIG. 6 by a coil spring 132. The plunger 130 is also adapted to be biased in the position illustrated in FIG. 5 by a permanent magnet 131 disposed within the actuator body 127. The permanent magnet 131 has enough attraction force to hold the plunger 130 in the FIG. 5 position once it has been moved into that position by suitable linkage, and the control signal from the control unit 82 is, in combination with the spring 132, operable to overcome the magnetic force to move the plunger 130 to the FIG. 6 position. The actuator 126 may be of a type manufactured by Ledex Inc., Dayton, Ohio.

As shown in FIGS. 2 and 3, the actuator 126 is suitably mounted on a support plate 133 secured on the frame 38. The plunger 130 is operative to engage a crank arm 134 to rotate same from the FIG. 5 position to the FIG. 6 position. The crank arm 134 is connected to a cross shaft 136 which is also connected to an intermediate link 138, FIG. 2. The link 138 supports an actuating shaft 140 which extends through elongated slots 115, one shown, in the lockout link 114 and is connected to the trip bar 100 for movement therewith. Referring to FIG. 2, the shaft 140 is also connected to a lockout push rod 142 and extends through a slot 141 formed in a reset link 144. The reset link 144 is coupled to a reset crank assembly 146 including a shaft 147, disposed on the frame 38, and a link 148. The link 148 is connected to a toggle link 150 which in turn is pivotally connected to a member 152 fixed to the crank 54. Torsion coil springs 156 are disposed about the shaft 147 and are operable to urge the shaft to rotate in a counterclockwise direction, viewing FIG. 2, to move the reset link 144 and effect counterclockwise rotation of the shaft 136 through the intermediate link 138. Counter clockwise rotation of the shaft 136 moves the arm 134 to move the actuator plunger 130 to the first stable position illustrated in FIG. 5. A further description of the operation of the reset linkage including the reset crank assembly 146, the toggel links 148 and 150 and the actuating springs 156 will be explained in further detail herein in conjunction with FIGS. 19 through 21.

Referring further to FIG. 2, the shaft 92, which is rotatable in response to reciprocating movement of the trip bar 100, is connected to a pivotally movable lockout catch 158 by way of an articulated connecting link 160. The catch 158 includes a recess 162 forming a surface for engagement with a pin 164 supported on an arm 166. The arm 166 is operably connected to the actuating member 98 and is disposed for movement with the crank link assembly 94 and is suitably connected thereto. The catch 158 is operable through the arm 166 to prevent movement of the actuating member 98 to close the switch 80 except in response to movement of the trip bar 100. Alternatively, rotation of the roller support arm 125 in a clockwise direction, viewing FIG. 2, will effect engagement of a cam pin 129 with a cam surface 161 on the catch 158 to move it out of its working position in engagement with the pin 164.

Figure 19:
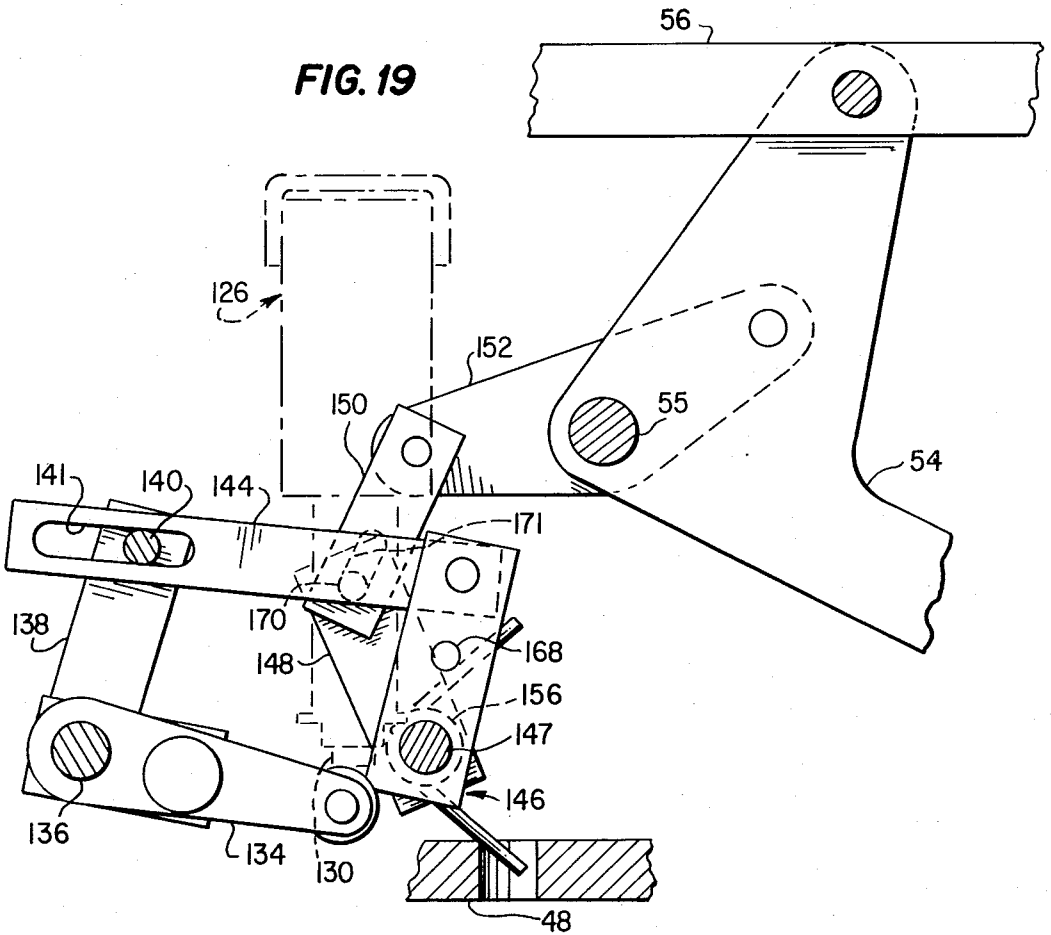
FIGS. 19 and 21 show details of the control actuator reset linkage moving from a position in FIG. 19 wherein the interrupter contacts are open to the position shown in FIG. 21 wherein the interrupter contacts are closed.
Figure 21:
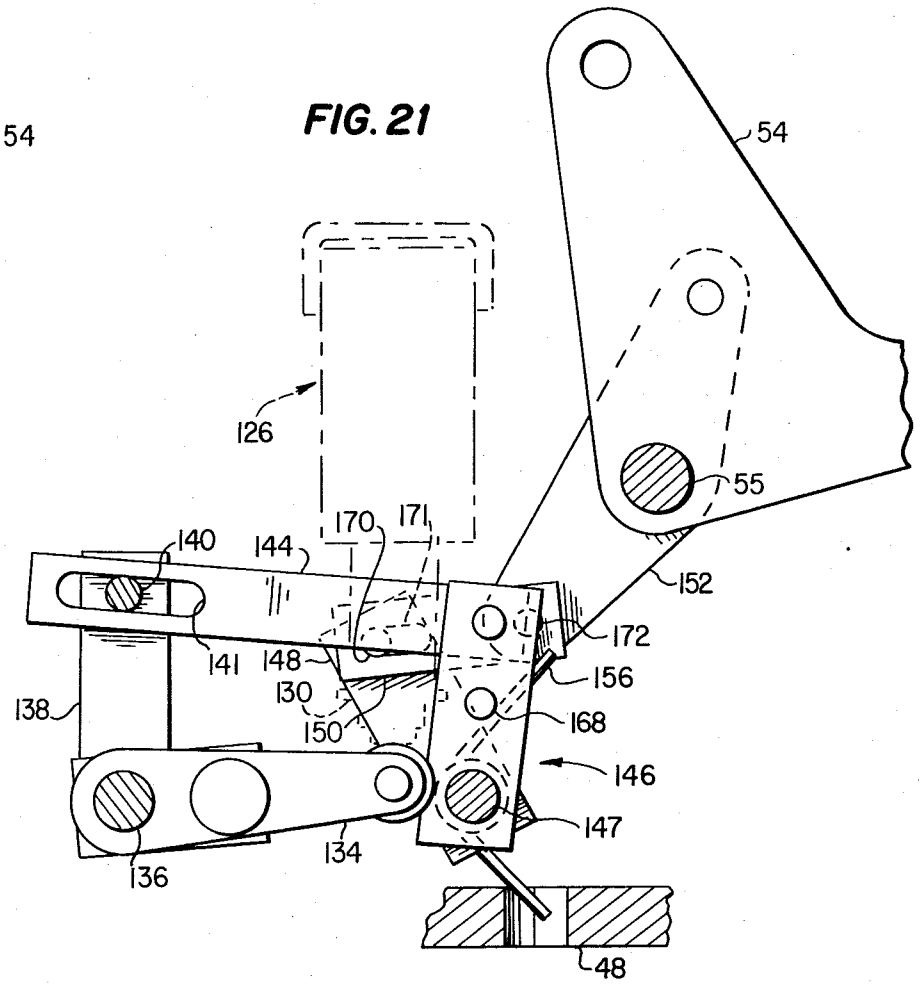
Figure 20:
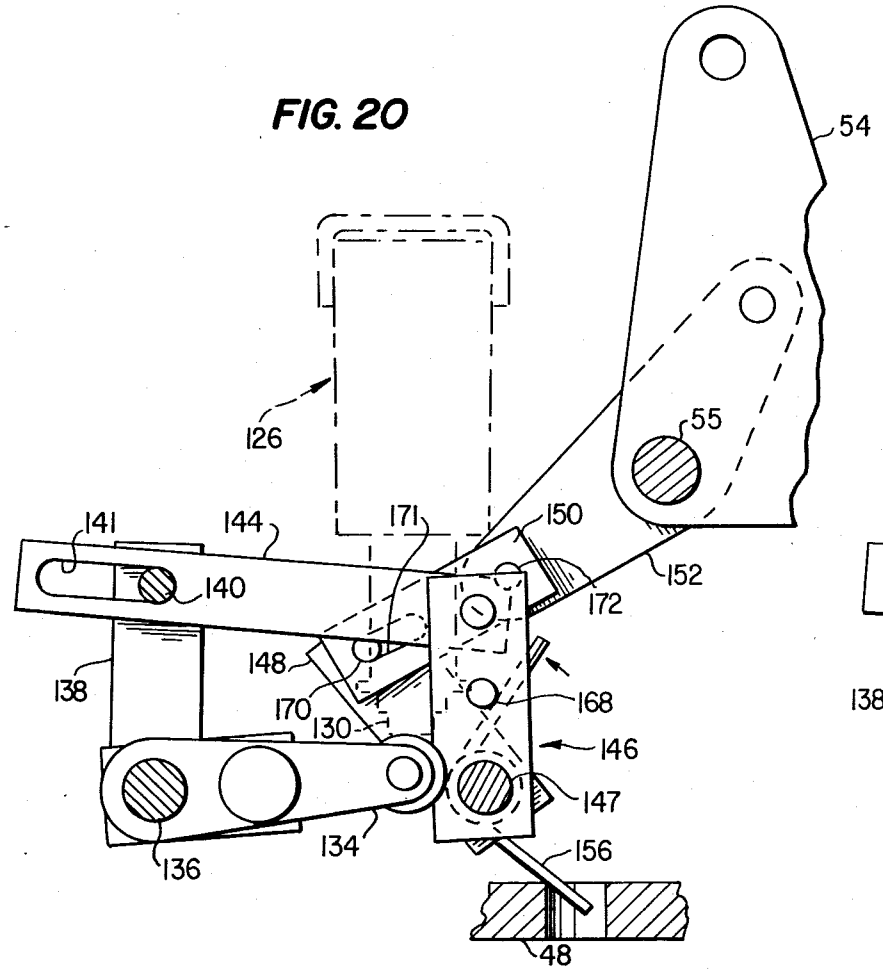

Referring now to FIGS. 19, 20 and 21, the construction and operation of the mechanism for resetting the control actuator 126 in its first position, will be described. In FIG. 19, the control actuator 126 is in a position wherein it has been energized to extend its plunger 130 to a second position. This operation will effect rotation of the arm 134 and shaft 136 in a clockwise direction, viewing FIG. 19, to move the trip bar 100, FIG. 2, through the intermediate link 138 and the shaft 140 to effect tripping of the latch 62. Accordingly, at this time the transfer bar 56 will be urged by the springs 58 to rotate the cranks 50, 52 and 54 rapidly to the open position of the interrupter contacts by forcing the contactor actuating rods 36 rapidly downwardly. The crank arm 54 is illustrated in FIG. 19 in the position wherein the interrupter contacts have been opened and a connection between the crank 54 formed by the operating member 152, the link 150 and the reset crank assembly 146 is such that the reset crank assembly 146, which is pivotally connected to the reset link 144 moves in a counterclockwise direction under the urging of the torsion coil springs 156. The coil springs 156 are engaged with a portion of the web 48 and with suitable stop pins 168, one shown, disposed on the reset crank assembly 146. The reset crank assembly 146 is connected to the link 150 through a lost motion toggle coupling including a pin 170 on the link 148 and a slot 171 formed in the link 150.

As the reset crank assembly 146 and the reset link 144 move in a counterclockwise direction to the position illustrated in FIG. 20, the shaft 140 bottoms in one end of the slot 141 and the energy in the springs 156 effect rotation of the intermediate link 138, the shaft 136 and the arm 134 to move the plunger 130 from its second stable position to its first stable position. This action may occur even though the transfer bar 56 and the crank arms 52 and 54 are moving toward or are in a position to hold the contactor actuating rods 36 in the interrupter contact open position. Accordingly, the springs 156 and the reset linkage comprising the crank assembly 146 and the link 144 can effect resetting of the control actuator 126 immediately upon operation of the interrupter device 30 to open the interrupter contact assemblies 32. Movement of the trip bar 100 to the right, viewing FIG. 2, effects rotation of the shaft 92 to release catch 158 only briefly from engagement with the arm 166 and the catch is repositioned to prevent the arm 166 and the actuating member 98 from closing the switch 80 as the shaft 72 rotates to raise the plunger 76.

Referring further to FIGS. 20 and 21, as the crank arm 54 is being moved in a counterclockwise direction during closing of the interrupter contacts, the operating member 152 and the link 150 move to a position wherein the centers of the pivot connection formed by the shaft 55 a pivot pin 172 and the pivot pin 170 become essentially colinear in FIG. 20 and then move to a position as illustrated in FIG. 21 wherein the reset crank assembly 146 is rotated back in a clockwise direction, viewing FIGS. 20, and 21, to recharge the springs 156 to their initial cocked position preparatory for another operation to reset the control actuator 126. Thanks to the lost motion coupling formed between the link 144 and the intermediate link 138, as provided by the shaft 140 and the slot 141, the control actuator 126 may be moved from its first stable position illustrated in FIG. 21 to its second stable position illustrated in FIG. 19 and the actuator 126 may be subsequently reset to its first stable position by the urging of the springs 156 acting through the reset crank assembly 146 and the reset link 144. Accordingly, the control actuator 126 can be actuated to effect tripping of the main latch 62 and then be reset to its first stable position almost instantaneously. In this way, the control actuator 126 can also be operated to effect reclosing of the contact assemblies 32 and operation of a lockout mechanism after a predetermined number of opening and closing cycles of the interrupter contact assemblies 32.

Figure 22:
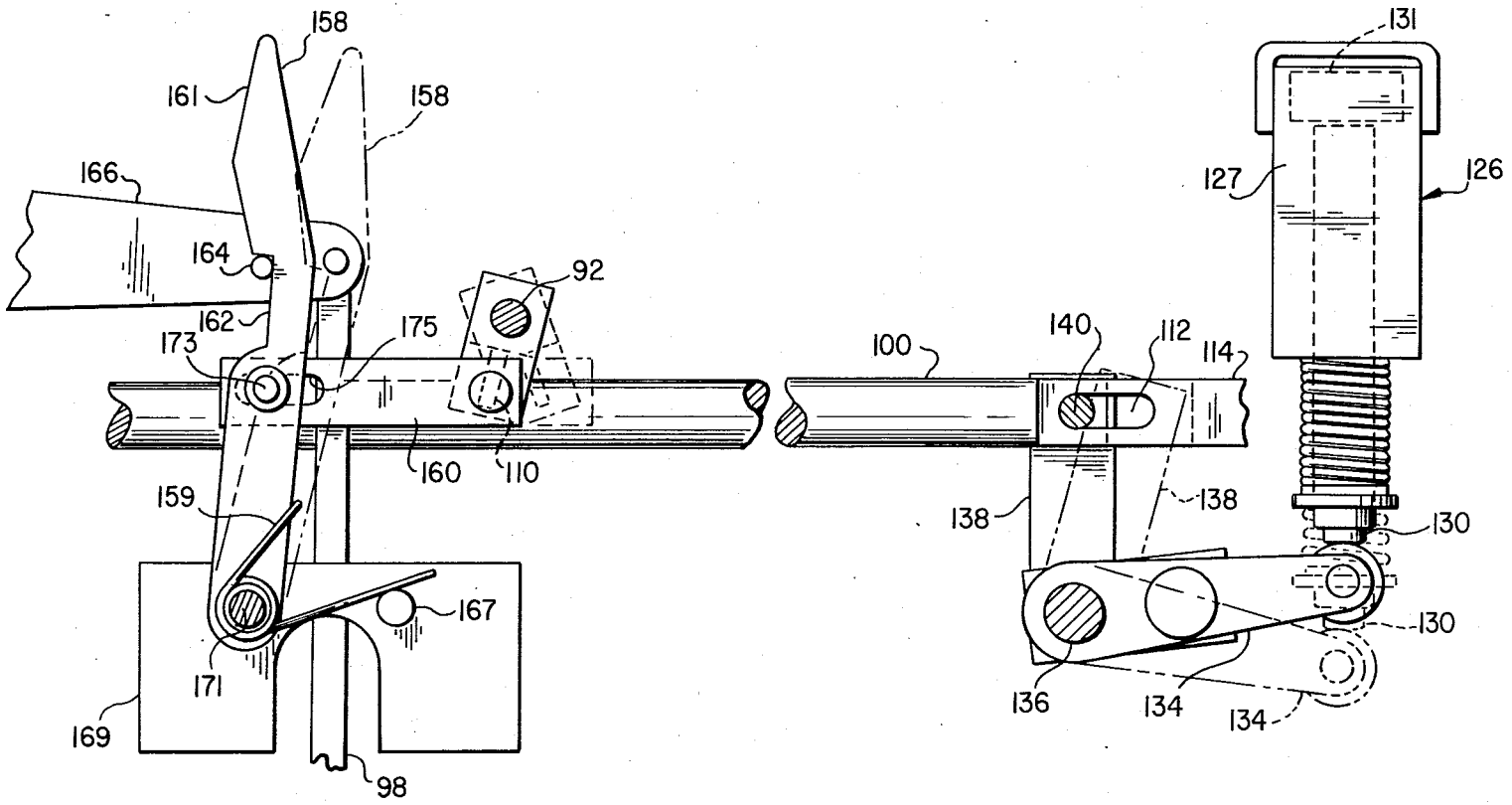
FIG. 22 illustrates the linkage interconnecting the control actuator with the solenoid contactor operating and locking mechanism.

FIG. 22 illustrates the operation of the actuator 126 to effect movement of the catch 158 to a position wherein it releases the arm 166 so that the actuating member 98 may move the switch 80 to a closed position for energizing the solenoid actuator 78. The catch 158 is biased in the position illustrated by the solid lines in FIG. 22 by a torsion coil spring 159 suitably engaged with the catch 158 and with a pin 167 mounted on a support member 169 for supporting the catch for pivotal movement about a pivot shaft 171. The member 169 is suitably mounted on the frame 38, FIG. 1. In the position shown by the solid lines in FIG. 22 the catch 158 prevents movement of the arm 166 and the member 98 to a position to close switch 80. As illustrated in FIG. 22, a lost motion coupling is formed between the link 160 and the catch 158 by a pin 173 and a slot 175 formed in the link 160. In this way, the actuator 126 and the trip bar 100 may be moved to the reset position with the plunger 130 in its first stable position without forcibly moving the catch 158 in a counterclockwise direction, viewing FIG. 22.

Referring now to FIGS. 8 through 12, in particular, the interrupter device 30 has an improved lockout mechanism for locking the interrupter contact assemblies 32 in an open position upon receipt by the control actuator 126 of a suitable lockout signal from the control unit 82. The lockout mechanism includes a lockout crank 178 which, secured on the shaft 72 and is connected to a connecting rod 180. The connecting rod 180 is connected to a lockout cam member 182. The cam member 182 is mounted for pivotal movement on the frame 38 about pivot shaft 92. The rod 142 is connected through a bellcrank 186 to a lockout bar connecting link 188 which is connected to an elongated lockout bar 189 through a lost motion coupling including a slot 190 formed in the link 188 and a pin 192 disposed on the lockout bar 189. The bellcrank 186 is pivotable about a shaft 187 whereby in response to movement of the actuator plunger 130 to the second stable position the link 188 moves generally vertically downward to allow the lockout bar 189 to be urged also generally downwardly under the urging of a coil spring 192 interconnecting the lockout bar 189 and a frame member 39. A second coil spring 194 also urges the rod 142 in a direction to bias the link 188 generally upwardly to a reset position.

Figure 8:
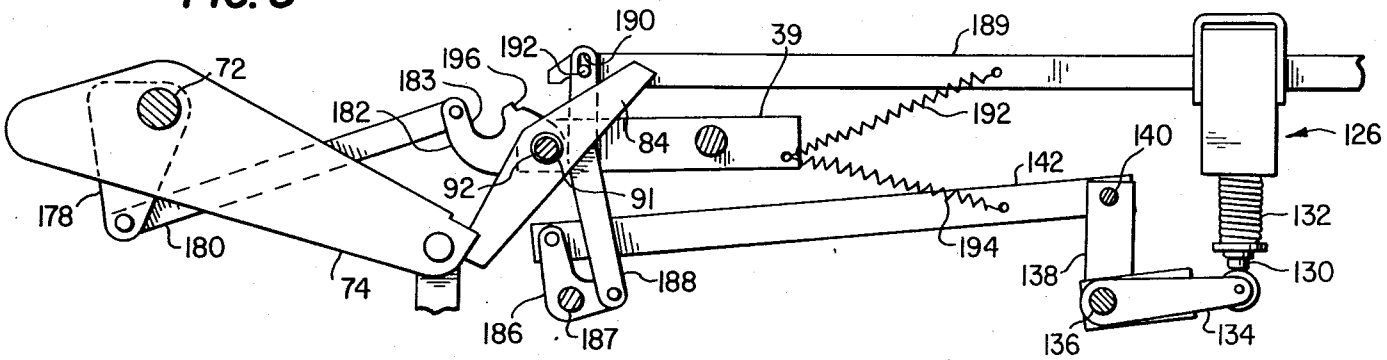
FIGS. 8 through 12 show the operating sequence of the control actuator and associated contact lockout linkage moving from an unlocked condition to a full lockout condition in response to actuation of the control actuator to lock the interrupter contacts in an open position.

FIG. 8 illustrates a condition of the control actuator 126 and the associated lockout mechanism wherein the actuator has moved from its first stable position to its second stable position and then having been reset to its first stable position by the reset mechanism before the solenoid crank arm 74 has been released by the solenoid latch 84 to move in a counterclockwise direction about the pivot shaft 72. This is also the position of the actuator 126 and the associated lockout mechanism when the interrupter contact assemblies 32 are closed.

Figures 9, 10, 11:
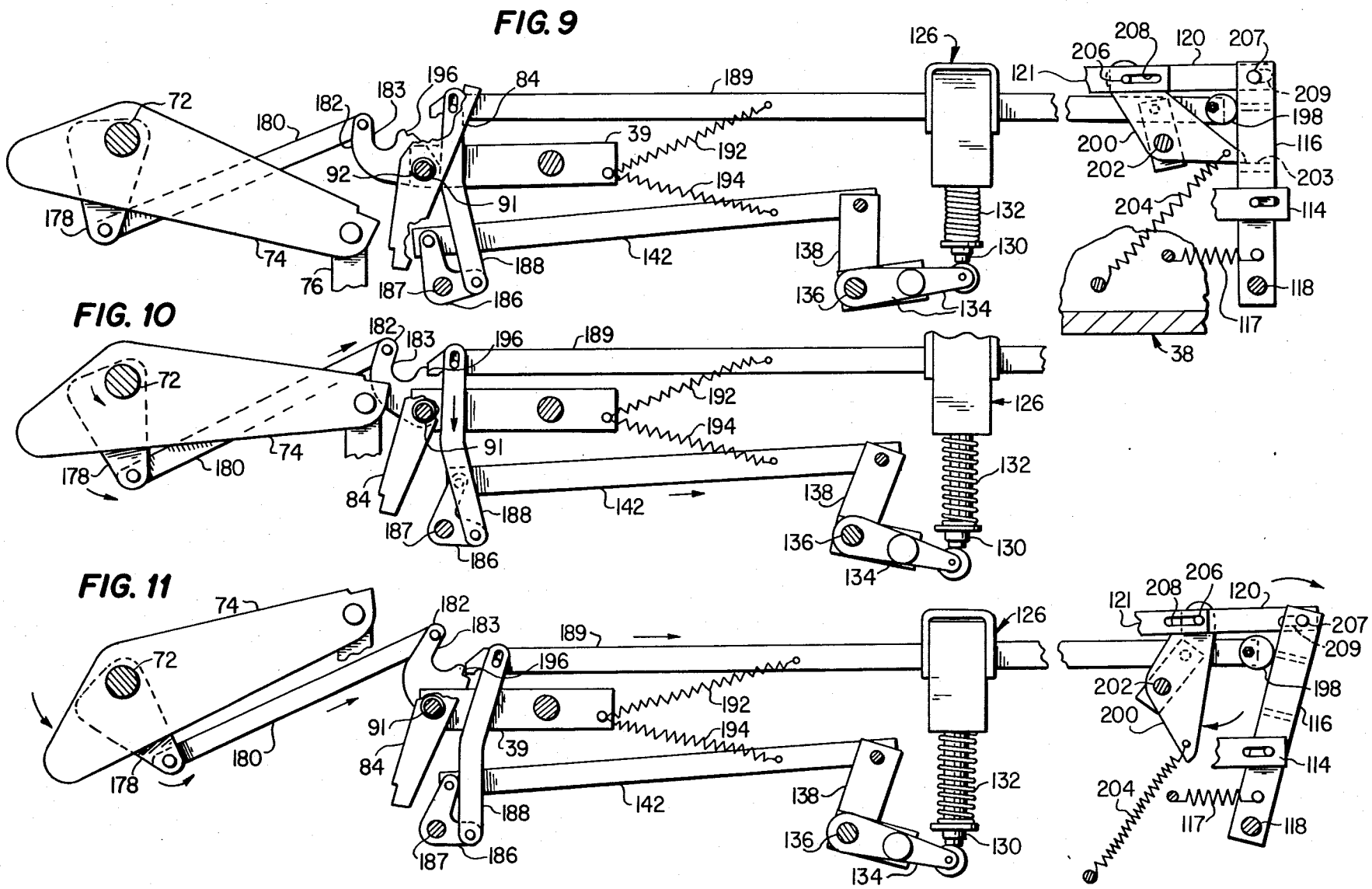

FIG. 9 illustrates a condition wherein the solenoid latch 84 has been pivoted out of its latching position and the crank arm 74 and shaft 72 are starting to move in a counterclockwise direction to effect pivotal movement of the lockout cam 182 in a clockwise direction, viewing FIG. 9, about the pivot shaft 91. At this time in the operating sequence of the interrupter device 30, if a predetermined number of opening and closing cycles of the interrupter contact assemblies 32 has occurred, a signal is transmitted from the control unit 82 to the control actuator 126 to again effect movement of the plunger 130 to the second stable position as indicated in FIG. 10. This second energization of the actuator 126 will effect downward movement of the link 188 to permit the lockout bar 189 to be urged into a position to be engaged by the cam 182 as illustrated in FIG. 10. The cam 182 includes a cam notch 196 which engages the end of the lockout bar 189.

Figure 12:
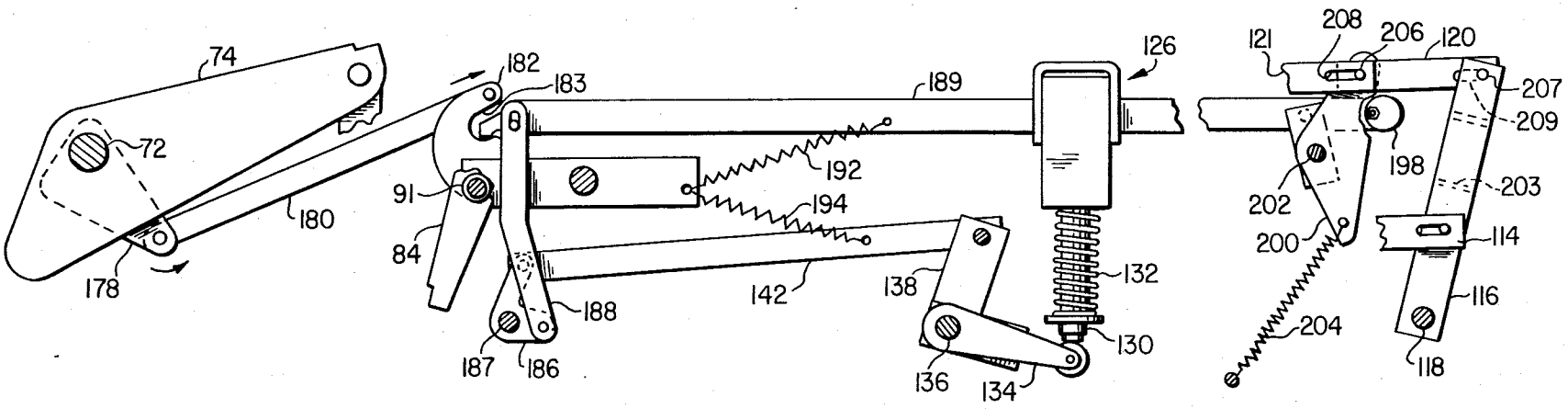

Continued rotation of the crank 178 in a counterclockwise direction will cause the lockout bar 189 to translate to the right to the position illustrated in FIG. 11 wherein the lockout bail member 116 engaged by an eccentric 198 disposed on the end of the lockout bar to effect clockwise movement of the bail about its pivot shaft 118 to release a lockout latch 200 for pivotal movement about the axis of a pivot shaft 202 supported on the frame 38. The lockout latch 200 is biased to turn in a clockwise direction by a coil spring 204, as shown in FIGS. 9, 11 and 12. The spring 204 is suitably supported on the Frame 38. As the lockout latch 200 moves from the FIG. 9 to the FIG. 11 position, it urges the bail 116 in a clockwise direction about the pivot shaft 118 through a coupling formed by a pin 206 on the latch 200 and connected to the actuating rod 120. The pin 206 also extends into a slot 208 formed in the rod section 121 to comprise a lost motion coupling between the rod sections 120 and 121. Movement of the lockout bail 116 to the position shown in FIGS. 11 and 12 effects movement of the rod assembly 120, 121, the link 122, FIG. 2, and the shaft 124 to rotate the roller 128 into a position to hold the actuating member 98 in a position to prevent closure of the switch 80.

As the lockout crank 178 moves to the position illustrated in FIG. 12, the lockout cam 182 is moved into a position to disengage the lockout bar 189 from the cam notch 196 whereby the lockout bar moves into a recess 183. Under the urging of the spring 192, the lockout bar 189 is translated back to a position spaced from the lockout bail 116. The lockout bail 116 and the roller 128 remain in the lockout position by suitable linkage, not shown, of the type used on the aforementioned models RVE and WVE reclosers. The bail 116 may through manual lever means, not shown, be manually reset to the FIG. 9 position by counterclockwise rotation of the lockout latch 200 back to the position illustrated in FIG. 9 and movement of the lockout bail 116 back to the FIG. 9 position through a lost motion coupling formed between the bail and the rod section 120 by a pin 207 and a slot 209 in th rod section 120. The bail 116 is biased relative to the rod section 120 into the position shown in FIG. 9 by suitable spring means, now shown. The bail 116 is also biased to its retracted position shown in FIG. 9 by a spring 117 connected to the frame 38.

Figure 14:
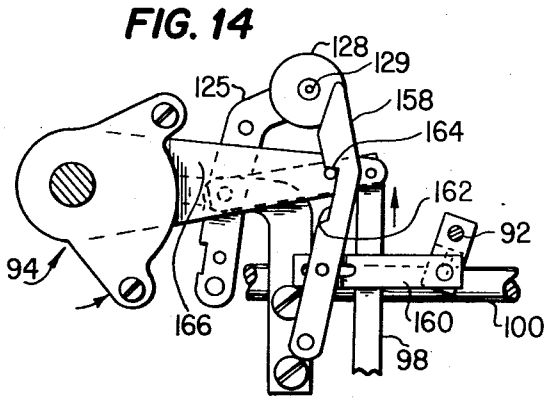
FIG. 14 is a view similar to FIG. 13 showing the solenoid switch actuating mechanism in a position wherein the interrupter contacts are open and the solenoid switch is held open by control actuator linkage.
Figure 13:
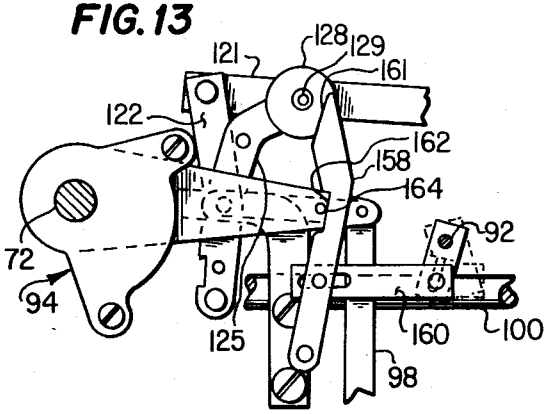
FIG. 13 is a detail view of the mechanism for actuating a reclosing solenoid switch in the position wherein the interrupter contacts are fully closed.
Figure 15:
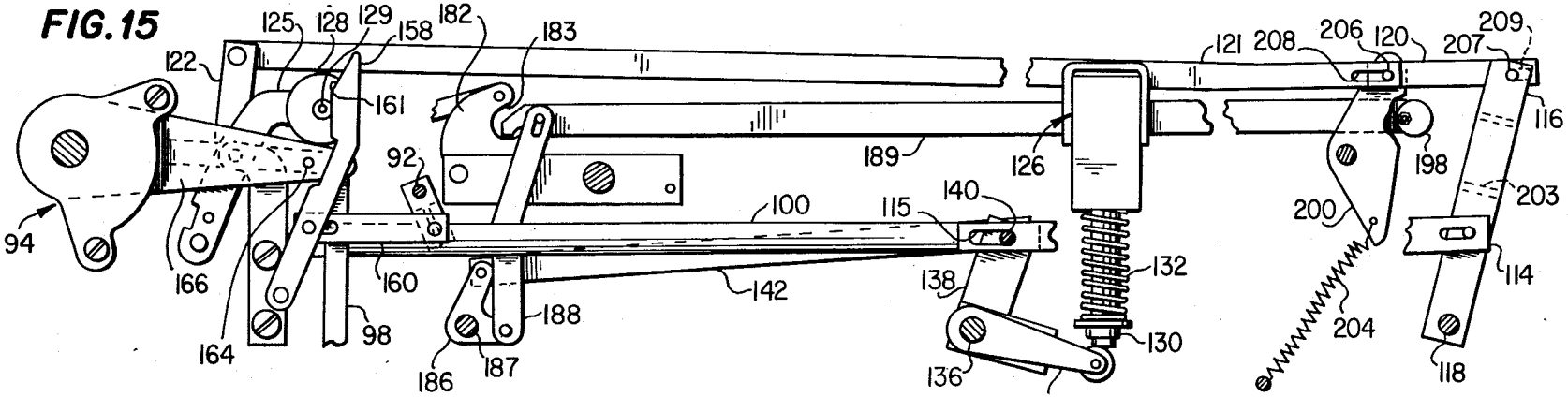
FIG. 15 illustrates the position of the solenoid switch actuating mechanism in the locked out condition to prevent reclosing of the interrupter contacts.

FIGS. 13, 14 and 15 show the relative positions of the mechanism for providing movement of the actuating member 98 to open and close the switch 80 and FIG. 15 illustrates the lockout mechanism in the locked out position of the interrupter device 30 to prevent actuation of the solenoid 78 and closure of the contact assemblies 32. FIG. 13, for example, illustrates the position of the linkage 94, the roller 128, the catch 158 and the arm 166 in their respective positions when the interrupter contact assemblies 32 are closed. In this position, the actuating member 98 is depressed by the linkage 94 to hold the switch 80 in the open position to prevent energization of the solenoid 78. FIG. 14 illustrates the relative positions of the above described components when the interrupter contact assemblies 32 are in the open position and the actuating member 98 is prevented from moving to close the switch 80 by the catch 158. FIG. 15 illustrates the position of the lockout mechanism and the mechanism for actuating the switch 80 in the locked out position of the interrupter device 30. In this position the catch 158 has been moved clear of the pin 164 by the cam pin 129 so that if the lockout bail 116 is manually reset to rotate the roller 128 out of the position shown in FIG. 15 the member 98 may move to close the switch 80. The spring 204 overcomes the bias of spring 117 to hold the latch 200 and the bail 116 in the positions shown in FIG. 12 when the bar 189 moves away from the bail.

Figure 16:
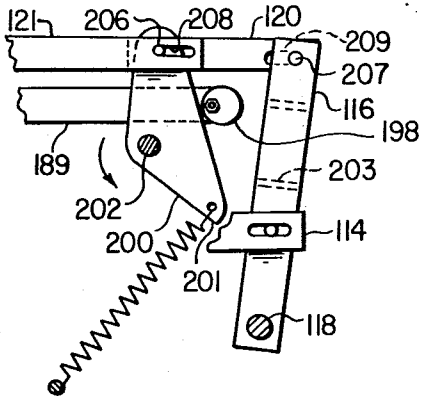
FIGS. 16 through 18 are detail views of a portion of the lockout mechanism showing the relative positions of the parts as the mechanism is being reset to an unlocked operating condition.
Figure 17:
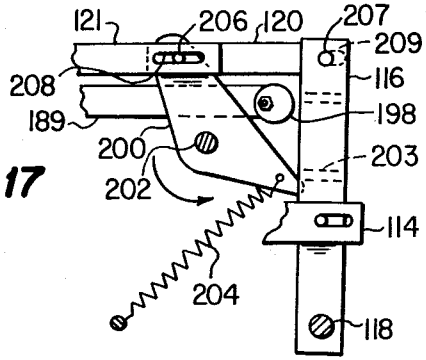
Figure 18:
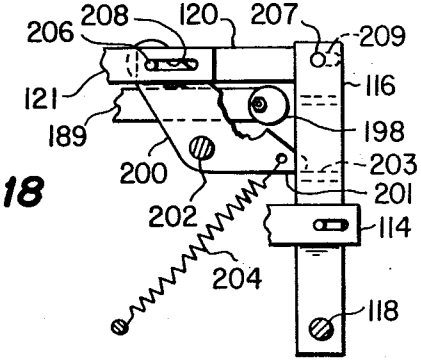

Referring to FIGS. 16 through 18, there is illustrated the sequence through which the lockout mechanism is manually reset. Suitable manual actuating means, not shown, is adapted to be connected to the lockout latch 200. As the latch 200 is moved in a counterclockwise direction, viewing FIGS. 16, 17 and 18, about the axis of shaft 202 a latch edge 201 interferes with a cam surface 203 on the lock out bail 116 momentarily urging the bail to move slightly clockwise about its pivot shaft 118. As the latch 200 is moved to the FIG. 18 position, the bail 116 repositions itself such that the surface 203 is engaged by the latch edge 201 to latch the lockout bail 116 in the non-lockout position. The solenoid latch 84 can be reset by torsion coil spring 85, FIG. 2, which is interactive between the latch and the boss 87 on the frame 38. The trip bar 100 is repositioned to the position shown in FIG. 5, for example, by movement of the actuator plunger 130 to its first stable position. However, after a lockout operation is effected, the interrupter contact assemblies 32 must be reclosed to reset the device 30 for further controlled operation.

The operation of the interrupter device 30 is believed to be readily understandable to those of skill in the art from the foregoing description. However, a brief discussion of the major operating steps will now be set forth. Actuation of the control actuator 126 to effect opening or tripping of the interrupter contact assemblies 32 is carried out by energization of the actuator to effect movement of the plunger 130 from its first position illustrated in FIG. 5 to its second position illustrated in FIG. 6. This movement of the actuator plunger 130 effects movement of the trip bar 100 to the right, viewing FIG. 6, through movement of the arm 134, the link 138 and the shaft 140. Movement of the trip bar 100 to the right causes the pin 108 to effect rotation of the cam 66 to effect release of the latch 62 whereby the springs 58, FIG. 2, move the transfer bar 56 to the right thereby rotating the crank levers 50, 52 and 54 to move the contact actuating rods 36 downwardly and simultaneously. As the crank lever 52 moves its associated rod 36 downwardly cam 90 engages the latch 84 and rotates same to release the crank arm 74 to move the plunger 76 upwardly to the FIG. 7 position. This permits resetting of the latch 62 in engagement with the cam 66 as illustrated in FIG. 7. When the actuator 126 is energized to move its plunger 130 to the second stable position the springs 156 immediately actuate the reset crank 146 to effect resetting of the plunger 130 to the first stable position.

After the trip bar 100 has been moved to effect tripping of the cam 66 it is immediately repositioned to the position illustrated in FIG. 7 which also results in positioning of the catch 158 to engage the pin 164 and prevent movement of the actuating member 98 to close the switch 80. Accordingly, reclosing of the contact assemblies 32 is not automatically effected as a result of tripping and opening of the contact assemblies but must await a second control signal from the control unit 82 or a similar source to be delivered to the actuator 126 to effect another cycle of moving the plunger 130 from its first stable position to its second stable position.

With the improved actuator 126 and a suitable control unit such as the control unit 82 a second signal may be delivered to the actuator 126 at a predetermined time to effect reclosing of the contact assemblies 32. When the actuator 126 has been energized to move to the second stable position with the contact assemblies 32 in their open position the catch 158 is moved to release engagement from the pin 164 whereby the actuating member 98 may be urged upwardly to effect reclosing of the switch 80. Reclosing of the switch 80 energizes the solenoid 78 to rotate the solenoid crank arm 74 in a clockwise direction to effect resetting of the linkage interconnecting the rods 36 to the position illustrated in FIG. 4 which is the closed position of the contact assemblies 32. As the crank 54 is moved to the position corresponding to the closed position of the contact assemblies 32 the actuator reset springs 156 are recharged and the reset crank assembly 146 is returned to the position illustrated in FIG. 21 in preparation for another operating cycle of the actuator 126. Movement of the shaft 72 in a clockwise direction under the urging of plunger 76 and crank arm 74 will effect downward movement of the switch actuating member 98 through the crank link 94 and the arm assembly 96 so that upon reclosing of the contact assemblies 32 the switch 80 is opened and the solenoid actuator 78 is deenergized.

During the reclosing operation on contact assemblies 32 the catch 158 is momentarily rotated by engagement of the pin 164 with the cam surface 161 until the pin again is disposed in the recess 162 and is secured by the catch.

As aforedescribed, operation of the mechanism to open the interrupter contact assemblies 32 is initiated by receipt of a fault current signal from one or more of the current transformers 83 to the control unit 82 whereupon a signal is transmitted to the control actuator 126. The control unit 82 may be constructed generally in accordance with the device described in U.S. Pat. No. 4,535,409 to James A. Jindrick et al or the system described in U.S. patent application Ser. No. 712,012 filed Mar. 14, 1985 by William N. LeCourt, both assigned to the assignee of the present invention. However, other control mechanisms may be utilized in conjunction with the control actuator 126.

During the initial movement of the mechanism of the device 30 to open the contact assemblies 32 the actuator plunger 130 is rapidly reset to its first stable position when the toggle connection between the reset crank assembly 146 and the crank arm 54 is moved overcenter or "broken". This action permits counterclockwise rotation of the crank assembly 146 under the urging of the springs 156, viewing FIGS. 19 through 21, whereby the arm 134 repositions the plunger 130 through the operative connection with the reset link 144. This independent movement of the crank assembly 146 at the urging of the springs 156 is accomplished at least in part by the lost motion coupling formed between the link 150 and the crank assembly 146 through the pin 170 and slot 171. Of course, as illustrated in FIGS. 20 and 21, as the crank member 54 moves back to the closed condition of the interrupter contact assemblies 32, the crank assembly 146 is moved back to a cocked position against the bias of the springs 156 in preparation for another operating cycle of the actuator 126.

Since the actuator 126 is stable in its first position illustrated in FIG. 21, if the interrupter contact assemblies 32 are open and the switch 80 is open and locked by the catch 158, the control actuator 126 may be energized through the control unit 82, for example, to effect a closing operation of the interrupter contact assemblies by moving the trip bar 100 through the arm 134, shaft 136, intermediate link 138 and shaft 140 to effect counterclockwise movement of the shaft 92, FIG. 2. This operation effects movement of the catch 158 in a clockwise direction to be clear of the pin 164 whereby the spring biased actuating member 98 will move upward to close the switch 80 and energize the contact closing solenoid 78. As the interrupter contact actuating linkage, including the crank arm 54, is moving from the position of the crank arm 54 shown in FIG. 19 to the position shown in FIG. 20, the springs 156 are operable to reset the plunger 130 in its first stable position through movement of the crank assembly 146, the reset link 144 and the arm 134.

In the event that a predetermined number of interrupter contact opening and closing cycles occur in a predetermined time period, the control actuator 126, may, in a predetermined time period after actuation to initiate opening of the interrupter contact 32 and having been reset, be actuated again to move to its second stable position with extension of the plunger 130. If this second energization of the actuator 126 should occur with the solenoid crank arm 74 in the position illustrated in FIGS. 8 through 10, which is approximately a time lapse of 60 microseconds, for example, the lockout rod 142 will effect movement of the link 188 sufficiently downwardly, viewing FIGS. 8 through 12, to allow the lockout bar 189 to position itself for engagement with the lockout cam notch 196. Rotation of the crank arm 74 from the position illustrated in FIG. 10 to the position illustrated in FIG. 11 will effect translation of the lockout bar 189 to move the lockout bail 116 and unlatch the lockout latch 200 whereupon the actuator rod 120, 121 will effect rotation of the shaft 124 into a position wherein the roller 128 will prevent upward movement of the actuating member 98 and closure of the switch 80. Continued movment of the lockout cam 182 to the position illustrated in FIG. 12 will permit retraction of the lock out bar 189 away from engagement with the lock out bail 116 so that the bail may be manually reset.

Energization of the actuator 126 to effect a lockout condition during movement of the transfer bar 56 to the open position of the actuating rods 36 will cause the actuator 126 to move to its second stable position and to remain in such position until manual resetting of the interrupter device 30 is carried out. Manual resetting of the device 30 is accomplished by the aforementioned manual rotation of the shaft 202 and the lockout latch 200 in a counterclockwise direction, viewing the drawing figures, to reposition the lockout bail 116 to the position illustrated in FIG. 18. As the lockout bail 116 moves to the reset position the lockout link 114 moves the intermediate link 138 through the lost motion coupling 112 to effect counterclockwise rotation of the shaft 136 and the crank arm 134 to move the actuating plunger 130 back to its first stable position against the bias of the spring 132.

As the lockout bail 116 moves to its reset position the actuating rod 120, 121 rotates the support arm 125 and cam 128 in a counterclockwise direction to allow the actuating member 98 to move upwardly. Since the cam pin 129 is engaged with the catch 158 it holds the catch clear of the pin 164 until the arm 166 is moved upwardly sufficiently to prevent catching the pin 164 in the recess 162. Accordingly, the switch 80 will close under the urging of mechanism associated with the crank link assembly 94 which may, for example, include a spring 91 as illustrated in FIG. 2. Closure of the switch 80, of course, energizes the solenoid actuator 78 to move the contactor actuating rods 36 upward to close the contact assemblies 32 and reposition the operating mechanism to that illustrated in FIGS. 4 and 5. As the crank arm 54 moves to the position illustrated in FIG. 21 the reset linkage associated with the crank arm is moved to recharge the springs 156 and prepare the reset mechanism for another operating cycle of the actuator 126.

It will be appreciated from the foregoing that a unique control actuator and associated mechanism is provided for a circuit interrupter device for opening and reclosing the interrupter contacts. Moreover, a particularly unique lock out mechanism is associated with the control actuator whereby the actuator can perform three separate functions in control of the circuit interrupter device. Although the control actuator has been described in conjunction with controlled reclosing type circuit interrupter, certain important features of the control actuator and its mechanism can be utilized in connection with similar types of circuit interrupters which are not automatically controlled for reclosing or equipped with lockout mechanisms.

The elements described herein may be manufactured of conventional engineering materials used in conjunction with circuit interrupter switch gear and the like.

Although a preferred embodiment of the invention has been described in detail, those skilled in the art will recognize that various substitutions and modifications may be made to the specific embodiment described without departing from the scope and spirit of the invention as recited in the appended claims.

What we claim is:

1. In a circuit interrupter device including movable circuit contact means for interrupting current flow between said movable contact means and further contact means, a frame, operating mechanism on said frame for moving said movable contact means between a closed position and an open position, said operating mechanism including a latch for latching said movable contact means in a closed position, means for moving said operating mechanism to effect movement of said movable contact means to a contact open position upon tripping of said latch, and motor means operably connected to said operating mechanism for moving said movable contact means to a closed position, a control actuator for effecting tripping of said latch to move said movable contact means to an open position, said control actuator comprising:

an actuator member disposed in a first position and responsive to a control signal to move to a second position;

control linkage responsive to movement of said actuator member from said first position to said second position to effect tripping of said latch;

means for resetting said actuator member from said second position to said first position upon movement of said movable contact toward said open position; and said means for resetting includes reset linkage interconnected between said actuator member and said operating mechanism and responsive to movement of said operating mechanism to reset said actuator member to said first position.

2. The device set forth in claim 1, including:

a lost motion coupling interconnecting said actuator member and said reset linkage to permit movement of said actuator member from said first position to said second position independent of movement of said reset linkage.

3. The device set forth in claim 1, wherein:

said reset linkage includes a crank member mounted for pivotal movement on said frame and spring means for urging said crank member to move said actuator member toward said first position.

4. The device set forth in claim 3, wherein:

said reset linkage includes a toggle connection between said crank member and said operating mechanism and operable to bias said reset linkage in a position to permit movement of said actuator member and said control linkage from said first position to said second position.

5. The device set forth in claim 1 or 4, wherein:

said control actuator includes magnet means operable to bias said actuator member in said first position, means for biasing said actuator member in said second position and means responsive to an electrical signal for moving said actuator member from said first position to said second position.

6. In a circuit interrupter device including movable circuit contact means for interrupting current flow between said movable contact means and further contact means, a frame, operating mechanism on said frame for moving said movable contact means between a closed position and an open position, said operating mechanism including a latch for latching said movable contact means in a closed position, means for moving said operating mechanism to effect movement of said movable contact means to a contact open position upon tripping of said latch, and motor means operably connected to said operating mechanism for moving said movable contact means to a closed position, a control actuator for effecting tripping of said latch to move said movable contact means to an open position, said control actuator comprising:

an actuator member disposed in a first position and responsive to a control signal to move to a second position;

control linkage responsive to movement of said actuator member from said first position to said second position to effect tripping of said latch;

means for resetting said actuator member from said second position to said first position upon movement of said movable contact toward said open position; and a switch for energizing said motor means, and catch means associated with said control actuator and operable to prevent closure of said switch when said actuator member is in said first position.

7. The device set forth in claim 6, wherein:

said catch means is connected to said control linkage by link means for moving said catch means to a position to permit closing of said switch in response to movement of said actuator member to said second position.

8. The device set forth in claim 7, including:

lockout mechanism operably associated with said control actuator and including a cam member movable from a retracted position to a lockout position to prevent closing of said switch.

9. The device set forth in claim 8, wherein:

said cam member is engageable with said catch means for moving said catch means to a position to permit closure of said switch when said cam member moves from said lockout position to said retracted position.

10. The device set forth in claim 9, wherein:

said link means for moving said catch means includes a lost motion coupling operable to permit movement of said catch means by said cam member.

11. In a circuit interrupter device including movable circuit contact means for interrupting current flow between said movable contact means and further contact means, a frame, operating mechanism on said frame for moving said movable contact means between a closed position and an open position, said operating mechanism including a latch for latching said movable contact means in a closed position, means for moving said operating mechanism to effect movement of said movable contact means to a contact open position upon tripping of said latch, and motor means operably connected to said operating mechanism for moving said movable contact means to a closed position, a control actuator for effecting tripping of said latch to move said movable contact means to an open position, said control actuator comprising:

an actuator member disposed in a first position and responsive to a control signal to move to a second position;

control linkage responsive to movement of said actuator member from said first position to said second position to effect tripping of said latch;

means for resetting said actuator member from said second position to said first position upon movement of said movable contact toward said open position; and a switch for energizing said motor means and lockout mechanism including a cam member operably connected to said actuator member and responsive to movement of said actuator member to said second position to move said cam member to a position to prevent operation of said switch.

12. The device set forth in claim 11, wherein:

said lockout mechanism includes linkage means operably connected to said cam member, said linkage means including a first member mounted on said frame for movement between a retracted position and a lockout position, a lockout latch engageable in a first position with said first member in said retracted position, said latch being movable to a second position upon operation of said lockout mechanism to move said cam member to prevent operation of said switch, and said lockout latch being operable to reset said lockout mechanism to the retracted position of said first member and to move said cam member to permit operation of said switch.

13. The device set forth in claim 12, wherein:

said lockout mechanism includes a link operably interconnecting said first member and said actuator member for moving said actuator member from its second position to its first position when said first member moves to said retracted position from said lockout position.

14. The device set forth in claim 12, wherein:

said operating mechanism includes a crank member, said motor means being connected to said crank member, and said lockout mechanism includes a connecting rod operably connected to said crank member for movement therewith when said operating mechanism is moving said movable contact to a contact open position, said lockout mechanism further includes a lockout bar operably connected to said actuator member and movable in response to movement of said actuator member to said second position, a lockout cam pivotally mounted on said frame and connected to said connecting rod for engaging said lockout bar to move said lockout bar and said first member to said lockout position in response to movement of said actuator member to said second position.

15. The device set forth in claim 14, wherein:

said lockout cam is movable to a position to permit movement of said lockout bar to a position away from said first member when said crank member moves to a position corresponding to the open position of said movable contact means so that said first member may move from said lockout position to said retracted position.

16. In a high voltage electrical circuit recloser device, operating mechanism for effecting actuation of at least one movable contact to interrupt current flow through conductor means connected to said device, said operating mechanism including a latch member for latching said operating mechanism in a closed position of said movable contact, and a solenoid actuator engaged with said operating mechanism for moving said operating mechanism to a closed position of said movable contact, switch means for energizing said solenoid actuator and an operating member for moving said switch means between operative open and closed positions, a trip member operable to engage said latch member for tripping said latch member to effect movement of said operating mechanism to move said movable contact to an open position, and control actuator operably connected to said trip member for moving said trip member to trip said latch member, said control actuator comprising a bi-stable solenoid actuator including a plunger, said plunger being operable to be held in a first position and in response to receiving a control signal to move to a second position, a reset mechanism including a pivotal crank member and spring means for moving said crank member to effect movement of said plunger from said second position to said first position, a lockout mechanism operably connected to said control actuator and to said operating member for preventing closure of said switch means, said control acutator being operable upon receiving a first control signal to effect movement of said trip member to move said operating mechanism to open said movable contact followed by resetting of said control actuator to said first position by said reset mechanism said control actuator being responsive to a second control signal within a predetermined time of receipt of said first control signal to move from said first position to said second position to actuate said lockout mechanism to prevent closure of said switch means.

17. The device set forth in claim 16, including:

catch means operably associated with said operating member for holding said operating member in an open position of said switch means and linkage means interconnecting said control actuator with said catch means and operable to move said catch means in response to a control signal delivered to said control actuator to permit operation of said switch means to effect operation of said solenoid actuator to move said movable contact to a contact closed position.

18. An electrical circuit interrupter switch device including at least one contact assembly having a movable contact and means for moving said movable contact between circuit closed and circuit open positions, said means comprising contact operating mechanism including a trippable latch member for causing said operating mechanism to open said contact, a trip member for tripping said latch member, motor means for resetting said latch member and said operating mechanism to a position for holding said movable contact in a closed circuit position, switch means for energizing said motor means to effect reclosing of said movable contact, and an operating member for moving said switch means between open and closed positions, a lockout linkage for holding said operating member in a switch open position to prevent reclosing of said movable contact, and a single control actuator operably connected to said trip member and said lockout linkage, said control actuator including an actuator member responsive to receiving a control signal to move from a first position to a second position and means for resetting said actuator member from said second position to said first position, catch means operably associated with said control actuator to prevent movement of said operating member to close said switch means when said actuator member is in said first position, said control actuator being operable in response to said actuator member moving to said second position to move said catch means to provide for said operating member to close said switch means to effect reclosing of said movable contact, said control actuator being operable when moving from said first position to said second position in a first operating cycle to effect tripping of said latch means to open said movable contact, and said control actuator being operable in a second operating cycle when moving from said first position to said second position with said movable contact in a circuit open position to effect operation of said operating member to close said switch means.

19. The device set forth in claim 18, wherein:

said means for resetting includes reset linkage interconnected between said actuator member and said operating mechanism and responsive to movement of said operating mechanism to reset said actuator member to said first position.

20. The device set forth in claim 19, including:

a lost motion coupling interconnecting said actuator member and said reset linkage to permit movement of said actuator member from said first position to said second position independent of movement of said reset linkage.

21. The device set forth in claim 19, wherein:

said reset linkage includes a crank member and spring means for urging said crank member to move said actuator member toward said first position.

22. The device set forth in claim 21, wherein:

said reset linkage includes a toggle connection between said crank member and said operating mechanism and operable to bias said reset linkage in a position to permit movement of said actuator member from said first position to said second position.

23. The device set forth in claim 18, wherein:

said lockout linkage includes a first member mounted on said device for movement between a retracted position and a lockout position in response to a second operating cycle of said control actuator occurring within a predetermined time period after said first operating cycle, said lockout linkage further including lockout latch means engageable in a first position with said first member in said retracted position, said latch means being movable to a second position upon operation of said lockout linkage to prevent operation of said switch means, and said latch means being operable to reset said lockout linkage to the retracted position of said first member and to permit operation of said switch means.

24. The device set forth in claim 23, wherein:

said lockout linkage includes a link operably interconnecting said first member and said actuator member for moving said actuator member from its second position to its first position when said first member moves to said retracted position from said lockout position.

25. The device set forth in claim 23, wherein:

said operating mechanism includes a crank member, said motor means being connected to said crank member, and said lockout linkage includes a connecting rod operably connected to said crank member for movement therewith when said operating mechanism is moving said movable contact to a contact open position, said lockout linkage further includes a lockout bar operably connected to said actuator member and movable in response to movement of said actuator member to said second position, a lockout cam connected to said connecting rod for engaging said lockout bar to move said lockout bar and said first member to said lockout position in response to movement of said actuator member to said second position.

26. The device set forth in claim 25, wherein:

said lockout cam is movable to a position to permit movement of said lockout bar to a position away from said first member when said crank member moves to a position corresponding to the open position of said movable contact so that said first member may move from said lockout position to said retracted position.

* * * * *